US011835014B2

(12) United States Patent
Ota et al.

(10) Patent No.: US 11,835,014 B2
(45) Date of Patent: Dec. 5, 2023

(54) CYLINDER HEAD FOR INTERNAL COMBUSTION ENGINE

(71) Applicant: Nissan Motor Co., Ltd., Yokohama (JP)

(72) Inventors: Jun Ota, Kanagawa (JP); Hironao Netsu, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 17/999,718

(22) PCT Filed: Jun. 29, 2020

(86) PCT No.: PCT/JP2020/025448
§ 371 (c)(1),
(2) Date: Nov. 23, 2022

(87) PCT Pub. No.: WO2022/003753
PCT Pub. Date: Jan. 6, 2022

(65) Prior Publication Data
US 2023/0349341 A1 Nov. 2, 2023

(51) Int. Cl.
*F02F 1/36* (2006.01)
*F02F 1/40* (2006.01)

(52) U.S. Cl.
CPC ..... *F02F 1/40* (2013.01)

(58) Field of Classification Search
CPC ..... F02F 1/40
See application file for complete search history.

(56) References Cited

U.S. PATENT DOCUMENTS

2021/0156335 A1* 5/2021 Cecil ..... F02F 1/4264

FOREIGN PATENT DOCUMENTS

| | | | |
|---|---|---|---|
| JP | 2000-161129 | A | 6/2000 |
| JP | 2002-70642 | A | 3/2002 |
| JP | 2009-115031 | A | 5/2009 |
| JP | 2017-193970 | A | 10/2017 |

* cited by examiner

*Primary Examiner* — Sizo B Vilakazi
*Assistant Examiner* — Arnold Castro
(74) *Attorney, Agent, or Firm* — Global IP Counselors, LLP

(57) ABSTRACT

An internal combustion engine cylinder head has a water jacket, a plurality of female threaded portions for attaching an exhaust component, and a plurality of bulging portions protruding into the water jacket. The water jacket has inlet portions for receiving cooling water and outlet portions for discharging the cooling water. The inlet portions are disposed in a central position of the water jacket in a cylinder row direction. The outlet portions are disposed on a lateral side of the cylinder head to which the exhaust component is attached. A spacing between the outlet portions is wider than a spacing between the inlet portions. The female threaded portions protrude into the water jacket so that the cooling water crosses an area around the female threaded portions in the cylinder row direction. The bulging portions extend from ends of the female threaded portions towards where the inlet portions are located.

4 Claims, 4 Drawing Sheets

CYLINDER HEAD FOR INTERNAL COMBUSTION ENGINE

CROSS-REFERENCE TO RELATED APPLICATIONS

This application is a U.S. national stage application of International Application No. PCT/JP2020/025448, filed on Jun. 29, 2020.

BACKGROUND

Technical Field

The present invention relates to an internal combustion engine cylinder head.

Background Information

For example, Patent Document 1 discloses a cylinder head to which an exhaust pipe mounting flange is fixed by bolts. In the cylinder head disclosed in Patent Document 1, an internal water jacket is formed so as to follow a row of cylinders. The cylinder head of Patent Document 1 is formed such that boss portions for attaching the exhaust pipe project into the water jacket.

However, in the cylinder head disclosed in Patent Document 1, the flow of cooling water inside the water jacket is uncertain. Therefore, in the cylinder head disclosed in Japanese Laid-Open Patent Publication No. 2000-161129 (Patent Document 1), the flow of cooling water around the boss portions is weak, and if the cooling water around the boss portions becomes stagnant, there is the risk that the boss portions will be sufficiently cooled.

In other words, in the cylinder head disclosed in Patent Document 1, when the exhaust pipe becomes hot during operation and the boss portions described above become hot, the threaded portions between the boss portions and the bolts may deform, causing loosening of the bolts.

In other words, there is room for further improvement of the cylinder head in terms of cooling the boss portions for attaching an exhaust component which becomes hot.

SUMMARY

An internal combustion engine cylinder head according to the present invention comprises a water jacket which discharges cooling water introduced through a plurality of inlet portions in the center through a plurality of outlet portions on the lateral side of the cylinder head to which an exhaust component is attached, a plurality of female threaded portions disposed on the lateral side of the cylinder head, and a plurality of bulging portions which protrude into the water jacket.

The outlet portions are disposed such that the spacing between those located on either side in the cylinder row direction is wider than the spacing of the inlet portions located on either side in the cylinder row direction.

The female threaded portions protrude into the water jacket and are disposed between the outlet portions located on either side in the cylinder low direction.

The bulging portions are disposed to extend from tips of the female threaded portions towards the side where the inlet portions are located.

The cylinder head can thus guide part of the cooling water flowing in through the inlet portions of the water jacket to the area around the female threaded portions, and strengthen the flow of the cooling water around the female threaded portions. Therefore, the internal combustion engine cylinder head according to the present invention can efficiently cool the female threaded portions to which an exhaust component is attached.

BRIEF DESCRIPTION OF THE DRAWINGS

Referring now to the attached drawings which form a part of this original disclosure.

DETAILED DESCRIPTION OF EMBODIMENTS

Embodiments of the present invention are described below in detail with reference to the drawings.

Figure 1:
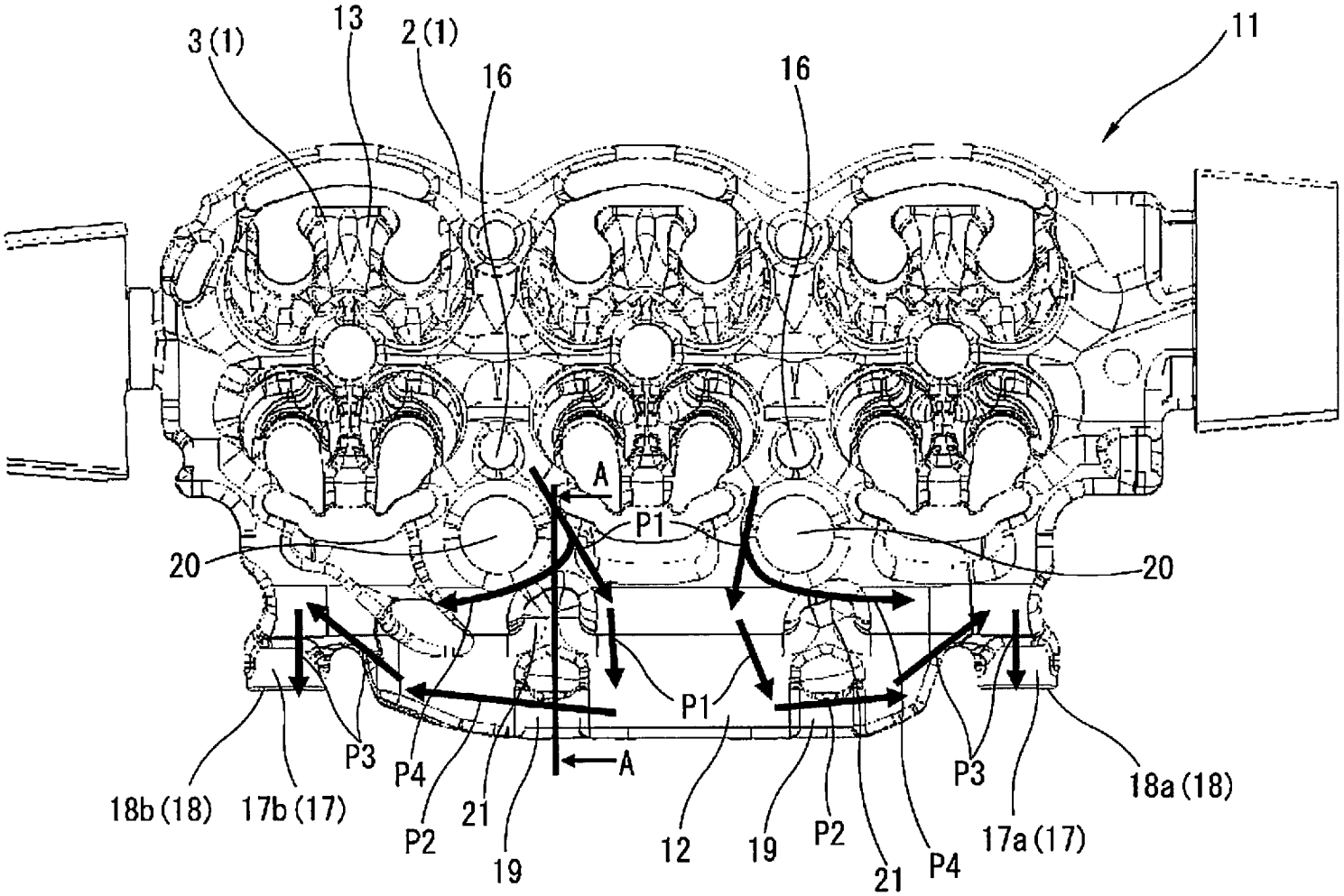
FIG. 1 is a bottom view of a core used in casting an internal combustion engine cylinder head according to the present invention.
Figure 2:
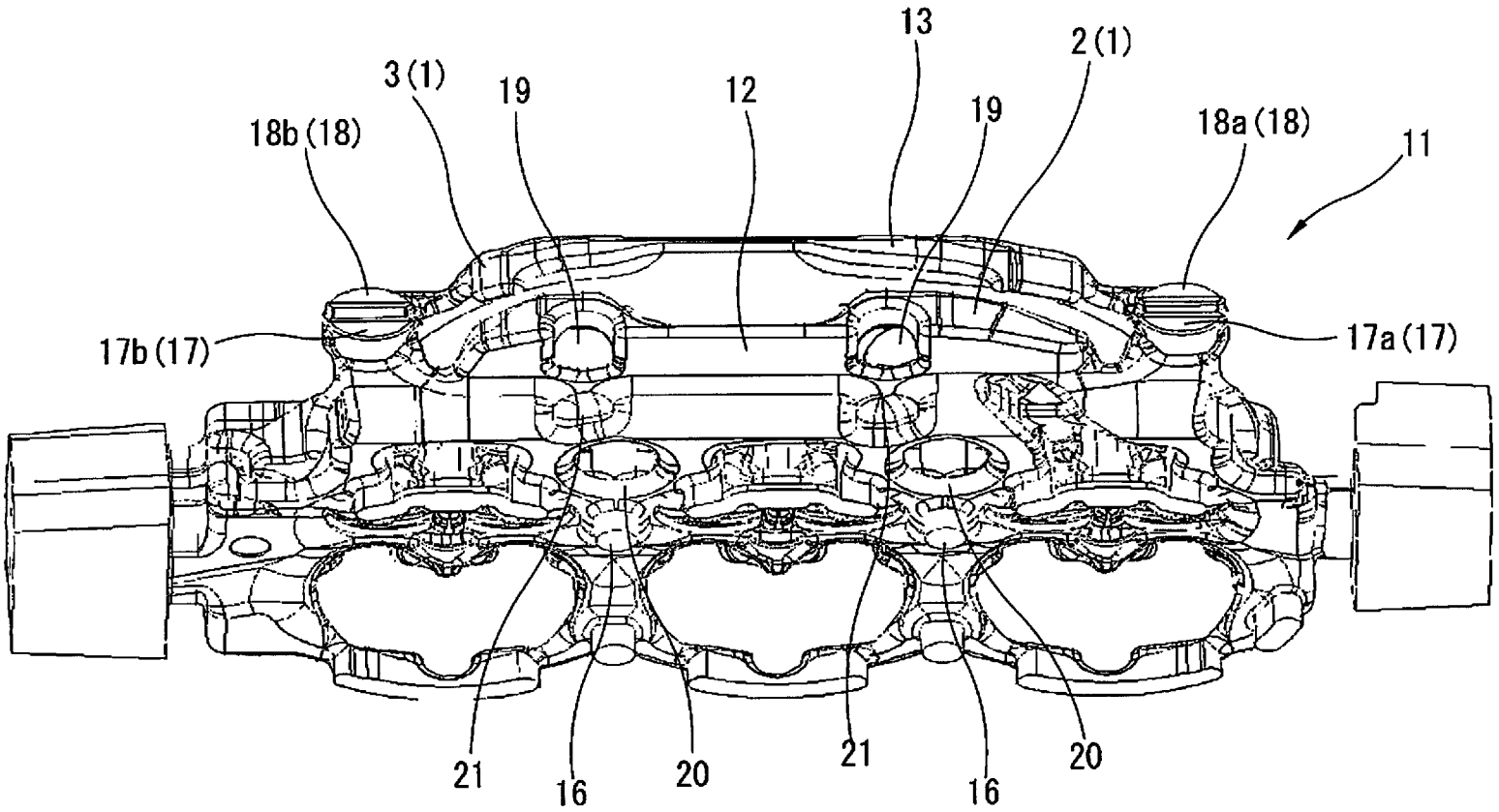
FIG. 2 is a perspective view of a core used in casting the internal combustion engine cylinder head according to the present invention.
Figure 3:
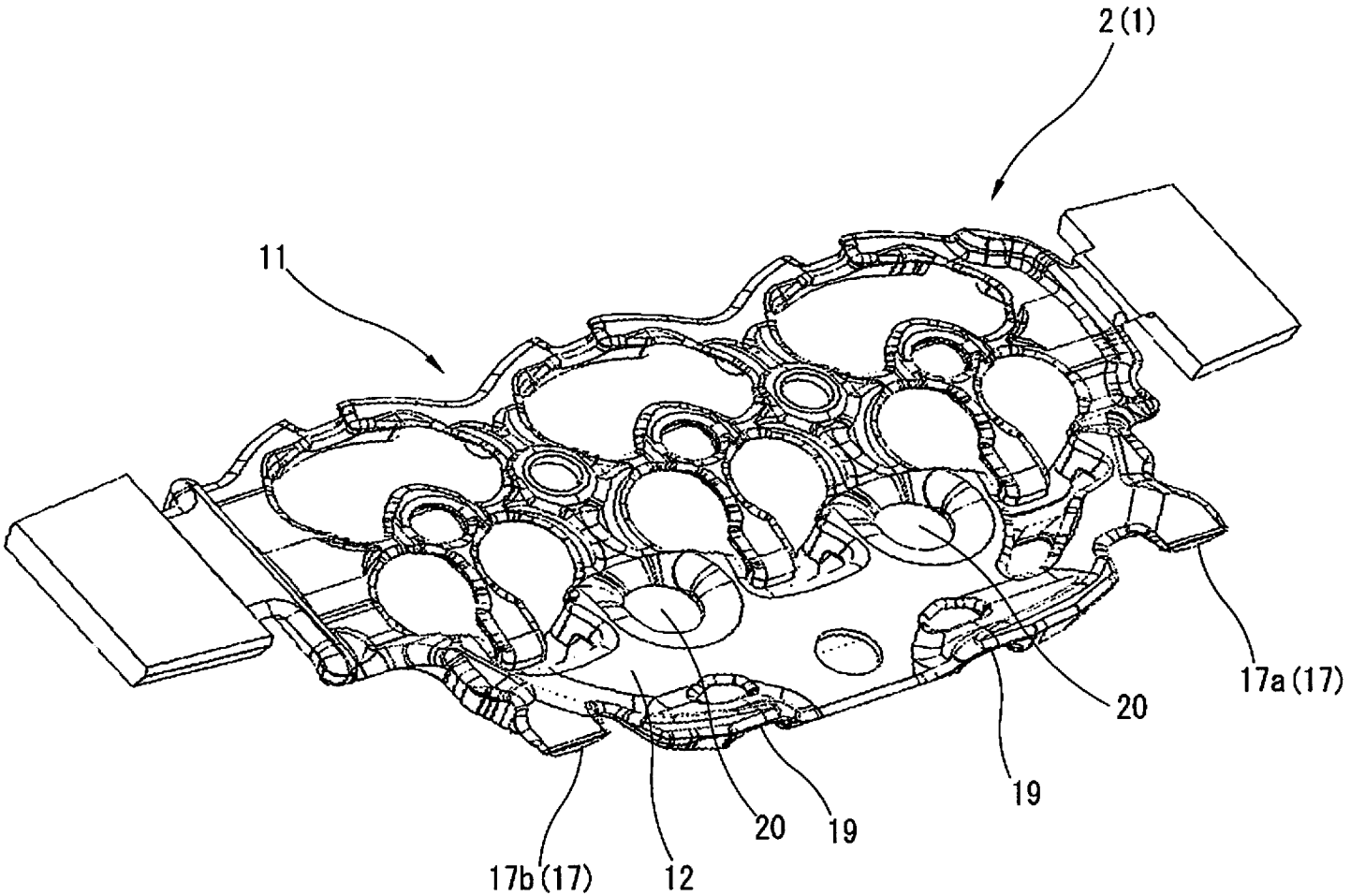
FIG. 3 is a perspective view of a first core forming a first water jacket on the cylinder block side.
Figure 4:
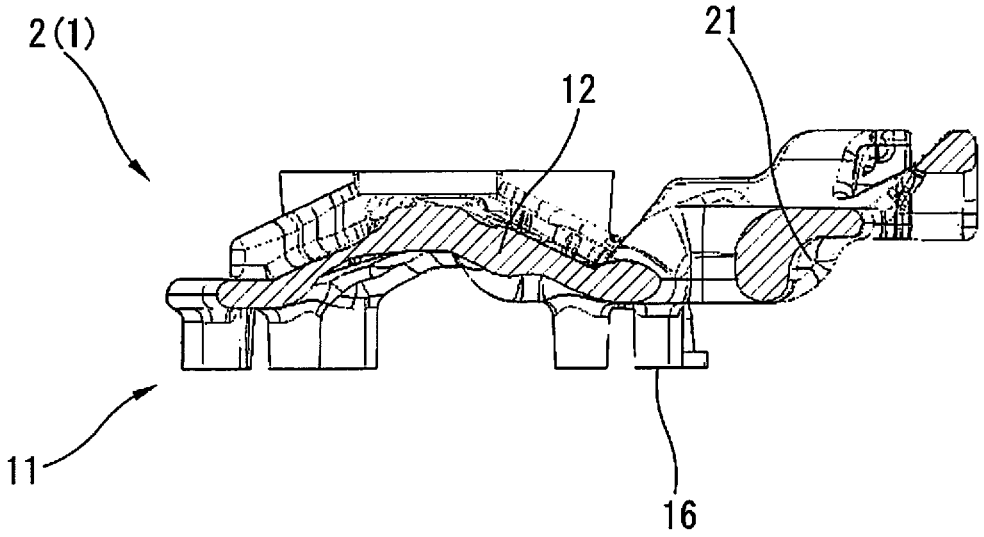
FIG. 4 is a cross-sectional view of the first core along line A-A in FIG. 1.
Figure 5:
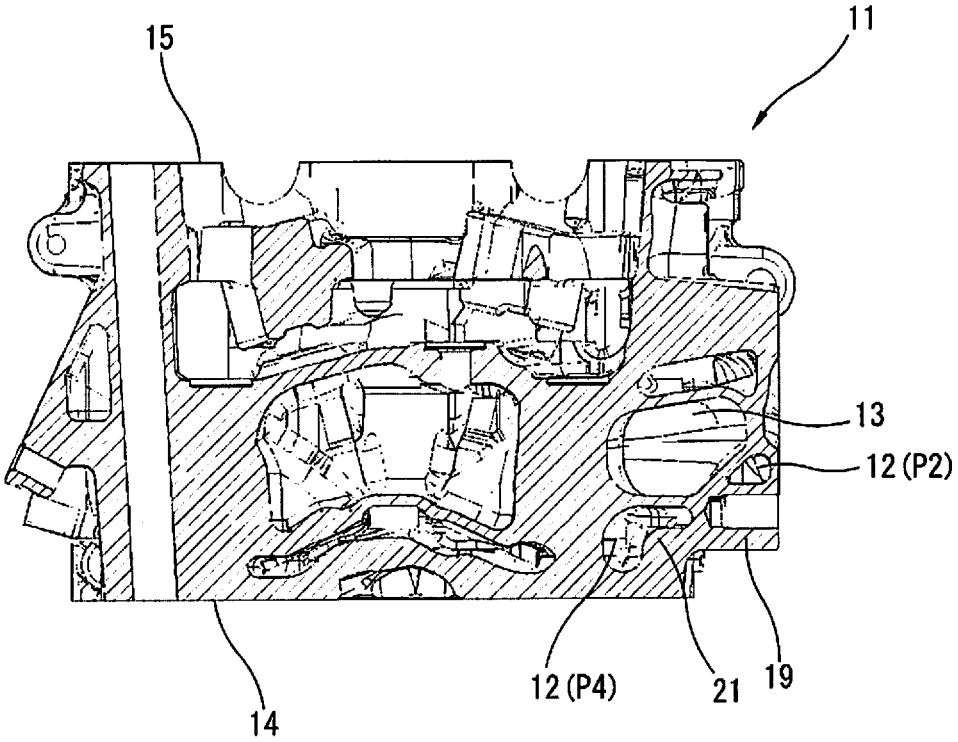
FIG. 5 is a cross-sectional view of the principal parts of the internal combustion engine cylinder head according to the present invention.

FIG. 1 is a bottom view of a core 1 used in casting an internal combustion engine cylinder head 11 according to the present invention. FIG. 2 is an oblique view of the core 1 seen from below used in manufacturing the internal combustion engine cylinder head 11 according to the present invention. FIG. 3 is a perspective view of a first core 2, which forms a first water jacket 12 on the cylinder block side, of the core 1 used in casting the internal combustion engine cylinder head 11 according to the present invention. FIG. 4 is a cross-sectional view of the first core 2 along line A-A in FIG. 1. FIG. 5 is a cross-sectional view of the principal parts of the cylinder head 11 of the internal combustion engine corresponding to the position along line A-A in FIG. 1.

The internal combustion engine of the present embodiment is an in-line three-cylinder engine, and the core 1 shown in FIGS. 1 to 4 shows one used in a case in which the internal combustion engine is an in-line three-cylinder engine.

Also, for the sake of convenience of the description, the cylinder head 11 is described with reference numerals assigned to corresponding positions of the core 1 shown in FIGS. 1 to 4. For the sake of convenience, locations with two-digit reference numerals among the reference numerals assigned to the core 1 shown in FIGS. 1 to 4 shall be described as indicating corresponding locations of the cylinder head 11. For example, the location assigned reference numeral 12 in FIG. 1 is a location corresponding to a first water jacket 12 of the cylinder head 11. The depressed portions in the core 1 shown in FIGS. 1 to 4 are portions which protrude into the cylinder head 11.

The internal combustion engine cylinder head 11 is made from an aluminum alloy, for example, with an exhaust component (not shown) attached to one lateral surface (one cylinder head lateral surface) side and an intake part (not shown) attached to the other lateral surface (another cylinder head lateral surface) side.

The cylinder head 11 is configured such that exhaust gas from each of the cylinders merges inside, and the merged exhaust gas flows through the exhaust component. In other words, the cylinder head 11 has an exhaust gas collection section disposed inside in which the exhaust gas from each of the cylinders merges.

The exhaust component is an exhaust turbo or manifold catalyst, for example. The intake part is an intake manifold, for example.

The internal combustion engine cylinder head 11 is cast using the core 1 shown in FIGS. 1 to 4. The core 1 forms a first water jacket 12 and a second water jacket 13 inside the cylinder head 11 and is the collective name for the first core 2 and a second core 3 in the present specification.

The first core 2 forms the first water jacket 12, serving as a water jacket. As shown in FIG. 5, the first water jacket 12 cools the cylinder block side of the cylinder head 11, which is the lower deck 14 side (bottom side).

The second core 3 forms the second water jacket 13. As shown in FIG. 5, the second water jacket 13 cools the side (not shown) of the cylinder head 11 which is relatively far away from the cylinder block, which is the upper deck 15 side (top side).

As shown in FIG. 2, the first core 2 and the second core 3 are disposed inside the casting mold so as to separate vertically during casting of the cylinder head 11. In other words, the first water jacket 12 on the lower deck 14 side and the second water jacket 13 on the upper deck 15 side located above the first water jacket 12 are disposed one above the other and spaced apart inside the cylinder head 11. In other words, the water jackets are disposed in two vertical layers inside the cylinder head 11 by the first water jacket 12 and the second water jacket 13.

The first water jacket 12 has two first cooling water inlet portions 16 and two first cooling water outlet portions 17.

As shown in FIGS. 1, 2, and 4, the first cooling water inlet portions 16 which serve as the inlet portions are disposed in a straight row along the cylinder row direction of the first water jacket 12 (cylinder head 11). The first cooling water inlet portions 16 are located between cylinders of the cylinder head 11. The first cooling water inlet portions 16 are disposed in a central location of the first water jacket 12 (cylinder head 11) in a direction at a right angle to the cylinder row. The first cooling water inlet portions 16 open in the lower deck 14 of the cylinder head 11 facing the upper deck (not shown) of the cylinder block (not shown). Cooling water flows into the first cooling water inlet portions 16 from cooling water passages (the cylinder block-side water jacket) disposed in the cylinder block outside of that which is shown in the drawings.

As shown in FIGS. 1 and 2, the first cooling water outlet portions 17, serving as the outlet portions, are located on one lateral surface side of the cylinder head 11 and are disposed in a straight row along the cylinder row direction. The first cooling water outlet portion 17*a* is disposed on one end of the cylinder head 11 in the cylinder row direction. The first cooling water outlet portion 17*b* is disposed on the other end of the cylinder head 11 in the cylinder row direction.

The spacing between these two first cooling water outlet portions 17 is disposed so as to be wider than the spacing of the two first cooling water inlet portions 16 along the cylinder row direction. In other words, the first cooling water outlet portions 17 are disposed such that the spacing between those located on either side in the cylinder row direction is wider than the spacing between the first cooling water inlet portions 16 located on either side in the cylinder row direction. Further, the two first cooling water outlet portions 17 are disposed so as to be located on either side of the two first cooling water inlet portions 16 in the cylinder row direction.

In other words, the two first cooling water inlet portions 16 are disposed so as to be located between the two first cooling water outlet portions 17 in the cylinder row direction. That is, the first cooling water inlet portions 16 are disposed so as to be located between the first cooling water outlet portions 17 located on either side in the cylinder row direction.

The second water jacket 13 has two second cooling water inlet portions 18 and a second cooling water outlet portion (not shown). The cooling water which has passed through the first cooling water outlet portions 17 is introduced into the second cooling water inlet portions 18.

More specifically, the cooling water which has passed through the first cooling water outlet portions 17 directly below is introduced into the second cooling water inlet portions 18. In other words, the cooling water which is passed through the first cooling water outlet portions 17*a* is introduced into the second cooling water inlet portion 18*a*, and the cooling water which is passed through the first cooling water outlet portion 17*b* is introduced into the second cooling water inlet portion 18*b*.

The cooling water introduced into the second water jacket 13 is discharged to the outside through the second cooling water outlet portions.

A plurality of female threads for attaching the exhaust component are disposed on one lateral surface side of the cylinder head 11. This plurality of female threads is disposed as two boss-type first female threaded portions 19 which are disposed on the lower deck 14 side of the cylinder head 11 and a plurality of boss-type second female threaded portions (not shown) disposed on the upper deck 15 side of the cylinder head 11.

The female threads for attaching the exhaust component transfer heat from the exhaust component which has become hot during operation of the internal combustion engine. In particular, the first female threaded portions 19 on the lower deck 14 side near the combustion chamber tend to become hotter than the second female threaded portions on the upper deck 15 side. The exhaust component is attached to the cylinder head 11 by bolts (not shown) that are inserted into the female threads.

As shown in FIGS. 1 to 3 and 5, the first female threaded portions 19, serving as the female threaded portions, are disposed such that the ends are oriented towards the other lateral surface side of the cylinder head 11 and protrude into the first water jacket 12. Note that FIGS. 1 to 3 show the core 1, and therefore the recesses in the core 1 are the first female threaded portions 19 in the cylinder head 11.

The first female threaded portions 19 are disposed so as to be located inside the two first cooling water outlet portions 17 in the cylinder row direction. In other words, the first female threaded portions 19 are disposed between (inside) the first cooling water outlet portions 17 located on either side in the cylinder row direction.

As shown in FIGS. 1 to 3, the cylinder head 11 has boss-like cylinder head bolt boss portions 20 in locations adjacent the first cooling water inlet portions 16. Note that FIGS. 1 to 3 show the core 1, and therefore hole sections in the core 1 are the cylinder head bolt boss portions 20 in the cylinder head 11.

The cylinder head bolt boss portions 20 are located on the cylinder head 11 lateral surface side of the first cooling water inlet portions 16. The cylinder head bolt boss portions 20 are such that cylinder head bolts (not shown) for affixing the cylinder head 11 to the cylinder block (not shown) pass through the interior (the inside). The cylinder head bolts (not shown) pass through boss holes (not shown) disposed in the cylinder head bolt boss portions 20. These boss holes are machined (bored) after casting of the cylinder head 11, for example.

As shown in FIGS. 1, 2, 4, and 5, the cylinder head 11 has two bulging portions 21 which are adjacent to the first female threaded portions 19 and protrude into the first water jacket 12. Note that FIGS. 1, 2, and 4 show the core 1, and therefore recessed portions of the core 1 are the bulging portions 21 in the cylinder head 11.

The bulging portions 21 extend from ends of the first female threaded portions 19 toward the side on which the first cooling water inlet portions 16 are located. The bulging portions 21 are disposed so as to be located between the cylinder head bolt boss portions 20 and the first female threaded portions 19.

As shown in FIG. 5, the bulging portions 21 are disposed such that the first water jacket 12 has a predetermined passage cross-sectional area in the positions of the bulging portions 21. In other words, the upper ends of the bulging portions 21 are not connected to an upper wall surface of the first water jacket 12.

The cooling water flowing into the first water jacket 12 flows from the first cooling water inlet portions 16 towards the first cooling water outlet portions 17. As indicated by arrows P1, P2, and P3 in FIG. 1, part of the cooling water flowing into the first water jacket 12 flows from the first cooling water inlet portions 16 towards one cylinder head lateral surface side, crosses around the area around the first female threaded portions 19 in the cylinder row direction, and flows to the first cooling water outlet portions 17.

As indicated by arrow P1 in FIG. 1, part of the cooling water flowing into the first water jacket 12 flows from the first cooling water inlet portions 16 towards one cylinder head lateral surface side. In other words, the cooling water flows inside the first water jacket 12 from the first cooling water inlet portions 16 towards a direction orthogonal to the cylinder row (transverse direction of the cylinder head 11). This is because the first cooling water inlet portions 16 and the first cooling water outlet portions 17 are disposed so as to be offset in the direction orthogonal to the cylinder row.

Here, in the cylinder head 11 according to the present embodiment, the bulging portions 21, which extend from the ends of the first female threaded portions 19 towards the side where the first cooling water inlet portions 16 are disposed, are disposed so as to protrude into the first water jacket 12.

Therefore, as indicated by arrow P2 in FIG. 1, the cooling water which has bypassed the bulging portions 21 is introduced into the area around the first female threaded portions 19, and the cylinder head 11 can therefore strengthen the flow of the cooling water around the first female threaded portions 19. In other words, the cylinder head 11, by having the bulging portions 21, can reduce the flow rate of the cooling water flowing through sites where the bulging portions 21 are disposed (cooling water going directly from the first cooling water inlet portions 16 to the first cooling water outlet portions 17 (arrow P4)) and correspondingly increase the flow rate of the cooling water flowing into the area around the first female threaded portions 19 (arrow P2). Further, the cylinder head 11 can efficiently cool the first female threaded portions 19 which tend to get hotter than the second female threaded portions.

As indicated by arrow P3 in FIG. 1, the cooling water introduced into the area around the first female threaded portions 19 flows towards the first cooling water outlet portions 17. This is because the two first cooling water outlet portions 17 are disposed so as to be located on either side (outside) of the first cooling water inlet portions 16 so as to sandwich all (two) of the first cooling water inlet portions 16 in the cylinder row direction.

The female threads disposed in the first female threaded portions 19 and the male threads of the bolts inserted into the first female threaded portions 19 may become deformed when the first female threaded portions 19 are in a high temperature state.

The cylinder head 11 can efficiently cool the first female threaded portions 19 which are more susceptible to high temperatures than the second female threaded portions, and therefore can suppress the tendency of the first female threaded portions 19 to become hot and the tendency of the female threads of the first female threaded portions 19 to deform. Further, the cylinder head 11 can suppress the tendency of the bolts inserted into the first female threaded portions 19 to become hot and the tendency of the male threads of these bolts to deform. In other words, the cylinder head 11 can efficiently cool the first female threaded portions 19 for attachment of the exhaust components and suppress the loosening of bolts in the first female threaded portions 19.

An embodiment of the present invention was described above, but the present invention is not limited to the foregoing embodiment and may be variously modified without departing from the essence of the invention.

For example, the number of the first female threaded portions 19 on the lower deck 14 side is not limited to two and may be three or more. The number of the bulging portions 21 is not limited to two and may be increased in accordance with the number of the first female threaded portions 19.

Further, the present invention can be applied to cylinder heads of multi-cylinder internal combustion engines having three or more cylinders and to cylinder heads in which the number of the first cooling water inlet portions 16 is three or more.

Moreover, the present invention can be applied to cylinder heads with one (one layer) internal water jacket.

The invention claimed is:

1. An internal combustion engine cylinder head comprising:

a water jacket in the cylinder head has a plurality of inlet portions through which cooling water is introduced and a plurality of outlet portions through which the cooling water is discharged;

a plurality of female threaded portions having female threads for attaching an exhaust component; and a plurality of bulging portions protruding into the water jacket, wherein the inlet portions are disposed in a central position of the water jacket in a row along a cylinder row direction, the outlet portions are disposed on one lateral surface side of the cylinder head in a row along the cylinder row direction to which the exhaust component is attached, and are disposed such that a spacing between adjacent ones of the outlet portions located on either side in the cylinder row direction is wider than a spacing between the inlet portions located on either side in the cylinder row direction, the female threaded portions are provided to the lateral surface side of the cylinder head, protrude into the water jacket, and are disposed between the outlet portions located on either side in the cylinder row direction, the water jacket is disposed around the female threaded portions so that the cooling water crosses an area around the female threaded portions in the cylinder row direction, and the bulging portions are disposed so as to extend from ends of the female threaded portions towards the side where the inlet portions are located.

2. The internal combustion engine cylinder head according to claim 1, further comprising cylinder head bolt boss portions located in positions adjacent the inlet portions, and the bulging portions being located between the cylinder head bolt boss portions and the female threaded portions.

3. The internal combustion engine cylinder head according to claim 1, wherein the bulging portions are disposed such that the water jacket has a predetermined passage cross-sectional area in locations of the bulging portions.

4. The internal combustion engine cylinder head according to claim 2, wherein the bulging portions are disposed such that the water jacket has a predetermined passage cross-sectional area in locations of the bulging portions.

* * * * *